US007481386B2

(12) United States Patent
Hartzler et al.

(10) Patent No.: US 7,481,386 B2
(45) **Date of Patent: *Jan. 27, 2009**

(54) CHIPPER FEED MECHANISM WITH PULSATING DOWN PRESSURE

(75) Inventors: Mark A. Hartzler, Marshallville, OH (US); John J. Eglin, Ashland, OH (US)

(73) Assignee: Rayco Manufacturing, Inc., Wooster, OH (US)

( * ) Notice: Subject to any disclaimer, the term of this patent is extended or adjusted under 35 U.S.C. 154(b) by 184 days.

This patent is subject to a terminal disclaimer.

(21) Appl. No.: 11/234,952

(22) Filed: Sep. 26, 2005

(65) Prior Publication Data

US 2007/0069051 A1 Mar. 29, 2007

(51) Int. Cl.
*B02C 25/00* (2006.01)

(52) U.S. Cl. ..... 241/34; 241/92

(58) Field of Classification Search ..... 241/34, 241/35, 92; 144/176, 246.1, 246.2
See application file for complete search history.

(56) References Cited

U.S. PATENT DOCUMENTS 5,205,496 A * 4/1993 O'Donnell et al. ..... 241/34
6,830,204 B1 * 12/2004 Morey ..... 241/34
2003/0111566 A1 6/2003 Seaman et al.

* cited by examiner

*Primary Examiner*—Mark Rosenbaum
(74) *Attorney, Agent, or Firm*—Sand & Sebolt

(57) ABSTRACT

A wood chipper includes an engine and a cutting assembly. A rotatable feed wheel and a gap-bounding member define therebetween an adjustable gap through which feed material moves toward the cutting assembly. An electronic control unit (ECU) controls force applied to the feed wheel or gap-bounding member toward the feed material in response to an operational condition of the wood chipper. The ECU can maintain or vary the force in any desired manner. One option is to apply the force with a pulsating mechanism in a pulsating manner to enhance the feeding procedure. The pulsating mechanism is in communication with a sensor from which the ECU receives signals typically indicating an operational speed of the cutting assembly or the engine. An ECU logic circuit permits the pulsating force only if the operational speed exceeds a predetermined threshold.

31 Claims, 6 Drawing Sheets

CHIPPER FEED MECHANISM WITH PULSATING DOWN PRESSURE

BACKGROUND OF THE INVENTION

1. Technical Field

The invention relates generally to wood chippers. More particularly, the invention relates to a control system for controlling the feed wheel of a wood chipper in order to provide improved feeding characteristics of the wood chipper. Specifically, the invention relates to such a control system in which the feed wheel is able to move up and down while rotating in order to provide increased down pressure on feed material in a pulsating manner.

2. Background Information

Typically, wood chippers include a feed chute, a rotating feed wheel and a cutting assembly whereby feed material is fed through the feed chute and drawn in by the feed wheel to the cutting assembly where the feed material such as branches and the like are cut by the cutting assembly. Some wood chippers utilize a single feed wheel while others utilize a pair of feed wheels which rotate in opposite directions to draw the feed material into the cutting assembly. Due to the various sizes of branches and logs that may be fed into a wood chipper, often the feed wheel or one of the feed wheels is movable in order to increase the size of the throat through which the feed material is drawn by the feed wheel. As disclosed in U.S. Patent Application Publication No. US2003/0111566 of Seaman et al., at least one wood chipper is known to have a feed control system which is hydraulically operated in order to provide additional pressure to the upper feed drum which corresponds to the pressure within the hydraulic motor which rotatingly drives the feed drum. Seaman et al. disclose a control system which when in automatic mode constantly urges the upper feed drum downwardly to apply a constant load to the feed material regardless of the position of the upper feed drum relative to the lower feed drum and thus regardless of the size of the gap between the two drums. The control mechanism of this wood chipper is entirely hydraulic in nature. More particularly, an increase in the load on the hydraulic motor which controls the upper feed drum causes an increase in the pressure of hydraulic fluid associated with the motor and this increased pressure of hydraulic fluid is directly applied to a hydraulic actuator to increase the down pressure on the feed drum. While this system has its advantages, it is also limited by the fact that the increased load on the feed wheel motor and thus the increased pressure on the hydraulic fluid can only be responded to by the increased down pressure of the feed drum. This control system is also operable in a manual mode in order to move the upper feed drum away from the lower feed drum to increase the gap to accommodate larger feed material or to provide additional down pressure on the feed drum when desired. Thus, while Seaman et al. provides certain advantages, there is still room for an improved feed mechanism for wood chippers.

BRIEF SUMMARY OF THE INVENTION

The present invention provides a method comprising the steps of rotating a feed wheel of a wood chipper to facilitate moving feed material toward a cutting assembly of the wood chipper via a gap defined between the feed wheel and a gap-bounding member; and controlling with an electronic control unit force applied via at least one of the feed wheel and the gap-bounding member toward the other of the feed wheel and gap-bounding member.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
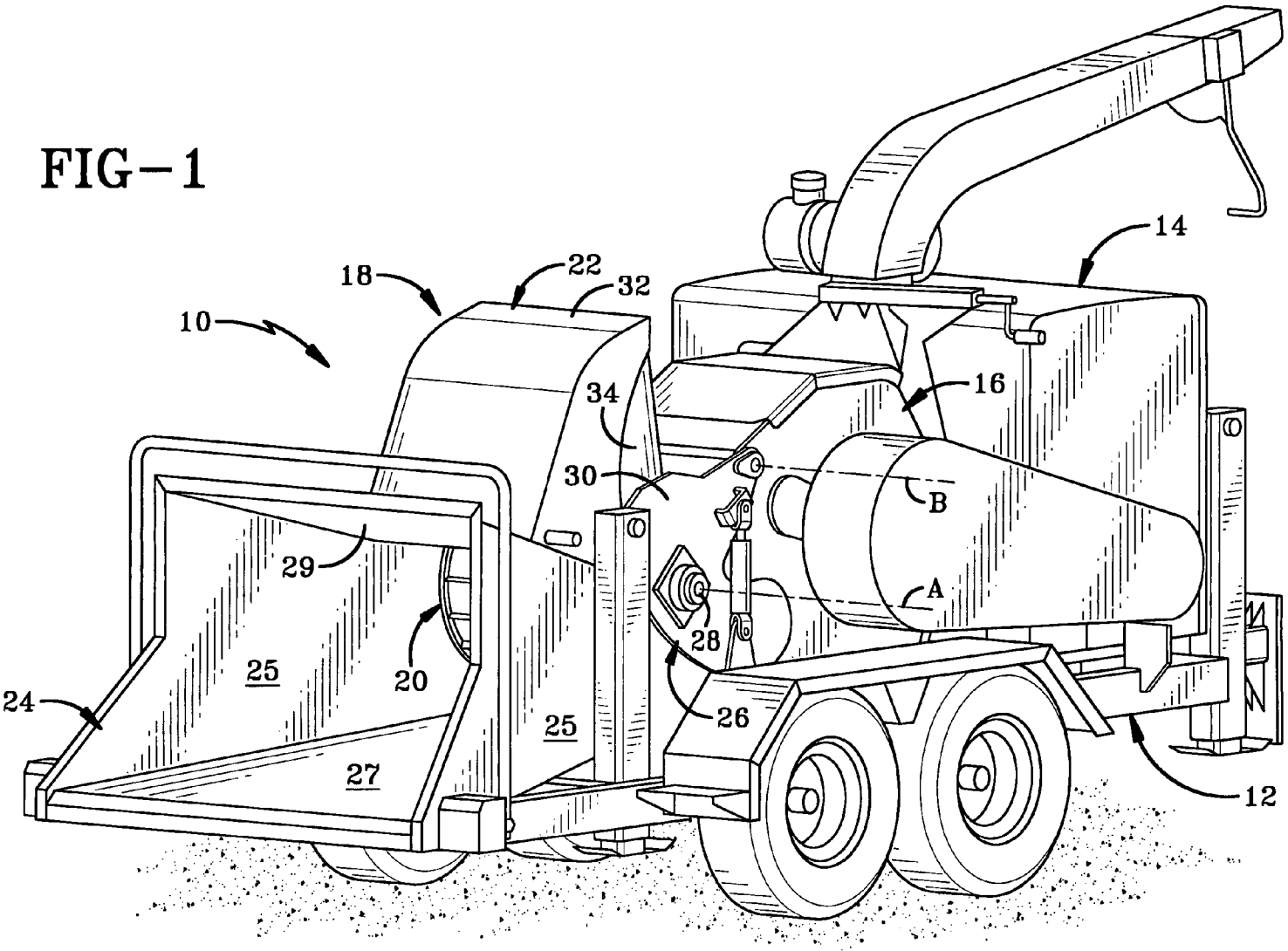
FIG. 1 is a perspective view of the wood chipper of the present invention.

The wood chipper of the present invention is indicated generally at 10 in FIG. 1. Wood chipper 10 is configured to control the down pressure typically applied by the feed wheel thereof in virtually any manner desired. In one preferred embodiment, wood chipper 10 is configured to apply increased force or pressure in a pulsating manner to feed material being fed into the wood chipper in order to improve the feeding characteristics thereof.

Wood chipper 10 is a wheeled vehicle having a frame 12 with an engine 14 mounted thereon. A cutting assembly 16 is mounted on frame 12 and is operatively connected to and powered by engine 14. A feed wheel assembly 18 is mounted on frame 12 adjacent cutting assembly 16 and opposite engine 14. Feed wheel assembly 18 includes a feed wheel 20 rotatably mounted within a feed wheel housing 22. A feed chute 24 is mounted adjacent feed wheel housing 22 whereby feed material may be fed through feed chute 24 into housing 22 and be drawn by feed wheel 20 into cutting assembly 16. Feed chute 24 includes a substantially flat bottom wall 27, a pair of spaced side walls 25 extending upwardly from bottom wall 27 and a top wall 29 extending between and connected to each of side walls 25. Side walls 25 and bottom wall 27 extend rearwardly to form respective portions of feed wheel housing 22. Feed wheel 20 is rotatably mounted on a carriage 26 about a first axis A which passes through an axle 28 of feed wheel 20. More particularly, carriage 26 includes a pair of carriage members 30 (only one shown) which are spaced from one another and disposed generally on either side of housing 22. Carriage 26 is pivotally mounted about an axis B which is substantially parallel to axis A. The pivotal mounting of carriage 26 allows for the pivotal movement of feed wheel 20 in a generally up and down direction. It is noted that while feed wheel 20 is oriented to rotate about a substantially horizontal axis and carriage 26 is also pivotal about a substantially horizontal axis, feed wheel 20, carriage 26 and the corresponding structure may be arranged so that the feed wheel and carriage respectively rotate and pivot about axes in different orientations. In addition, it is contemplated that a carriage may be movably mounted other than pivotally, such as along a linear path. Housing 22 includes a stationary portion 32 and a movable portion 34 which is rigidly mounted on carriage 26 and disposed between the spaced carriage members 30. Moveable portion 34 is thus moveable along with carriage 26 as it pivots about axis B.

Figure 2:
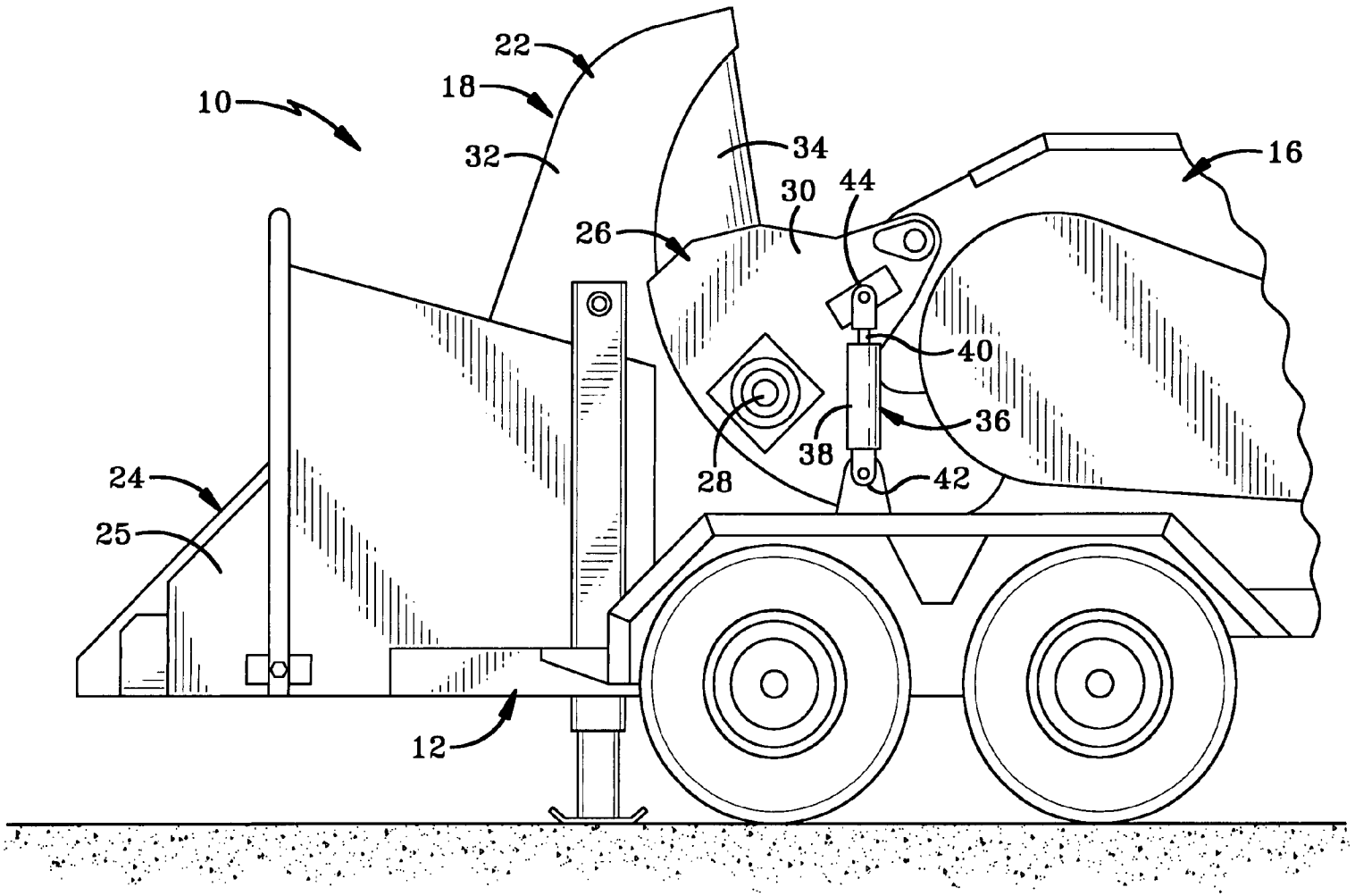
FIG. 2 is a fragmentary side elevational view showing the carriage on which the feed wheel is mounted and an actuator for moving the carriage in a generally up and down motion.

With reference to FIG. 2, wood chipper 10 includes an actuator 36 in the form of a hydraulic piston-cylinder combination having a cylinder 38 and piston 40. Cylinder 38 is pivotally connected adjacent a first end 42 of actuator 36 to frame 12 and cylinder 38 is pivotally mounted adjacent a second end 44 of actuator 36 to carriage 26. Actuator 36 is extendable and retractable between a retracted position shown in FIG. 2 and a fully extended position shown in FIG. 3. Actuator 36 thus moves carriage 26 and feed wheel 20 via axle 28 with respect to frame 12 of wood chipper 10.

Figure 3:
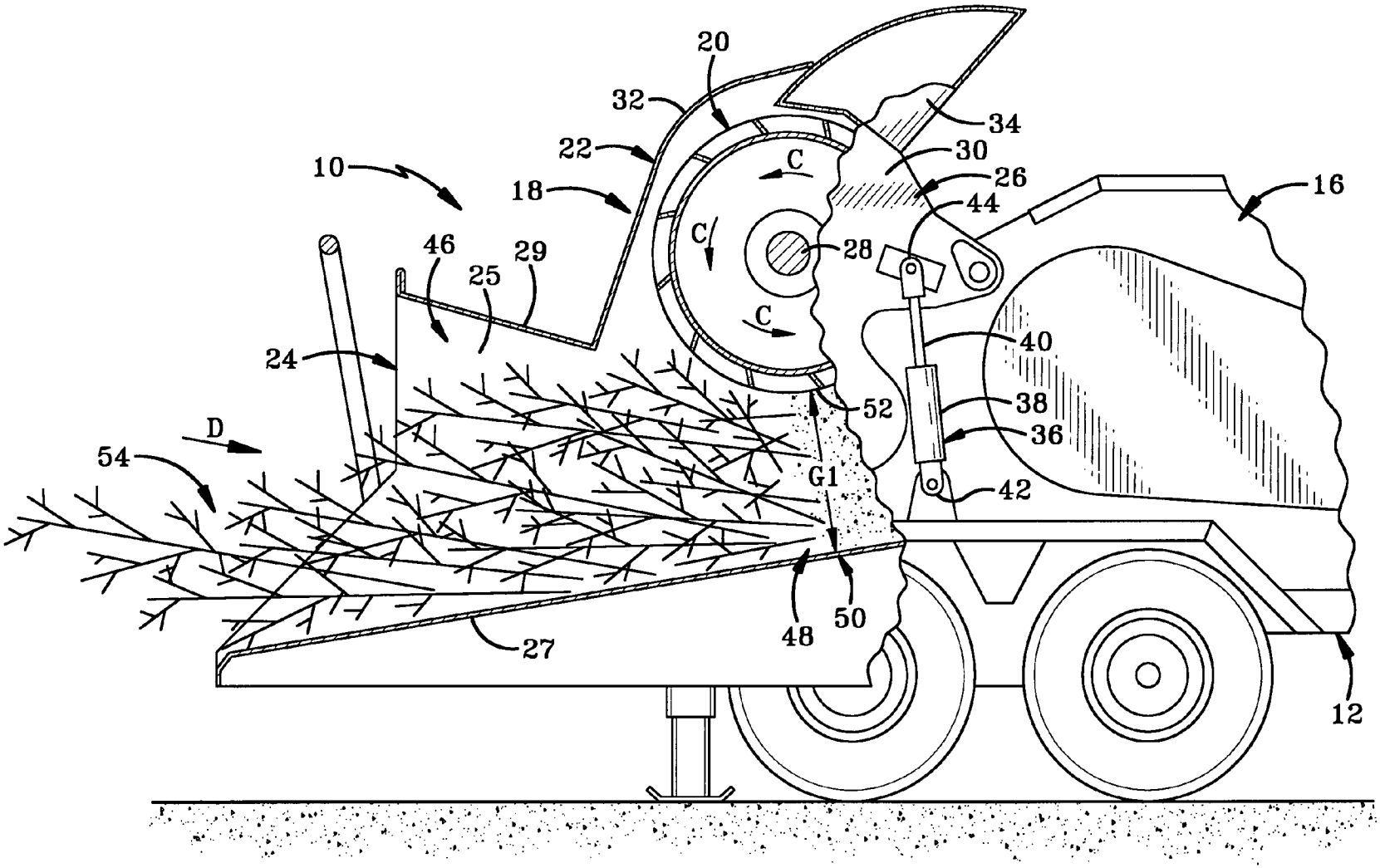
FIG. 3 is similar to FIG. 2 with portions cut away to show the feed wheel rotating in a forward direction at a first position with feed material being fed into the wood chipper.

With reference to FIG. 3, walls 25, 27 and 29 of feed chute 24 define an input 46 which narrows toward cutting assembly 16 to a throat 48 disposed below feed wheel 20. Throat 48 is bounded by and defined by feed wheel 20 and portions of side walls 25 and bottom wall 27 of feed chute 24, which are more particularly portions of feed wheel housing 22. More particularly, bottom wall 27 includes a gap-bounding portion or member 50 and feed wheel 20 includes a point or line 52 on the outer perimeter thereof wherein gap-bounding member 50 and point 52 on feed wheel 20 define therebetween a distance or gap G1 which varies with the movement of feed wheel 20 in response to the extension and retraction of actuator 36. Gap G1 represents the widest or nearly the widest gap in accordance with a full or nearly full extension of actuator 36.

Figure 4:
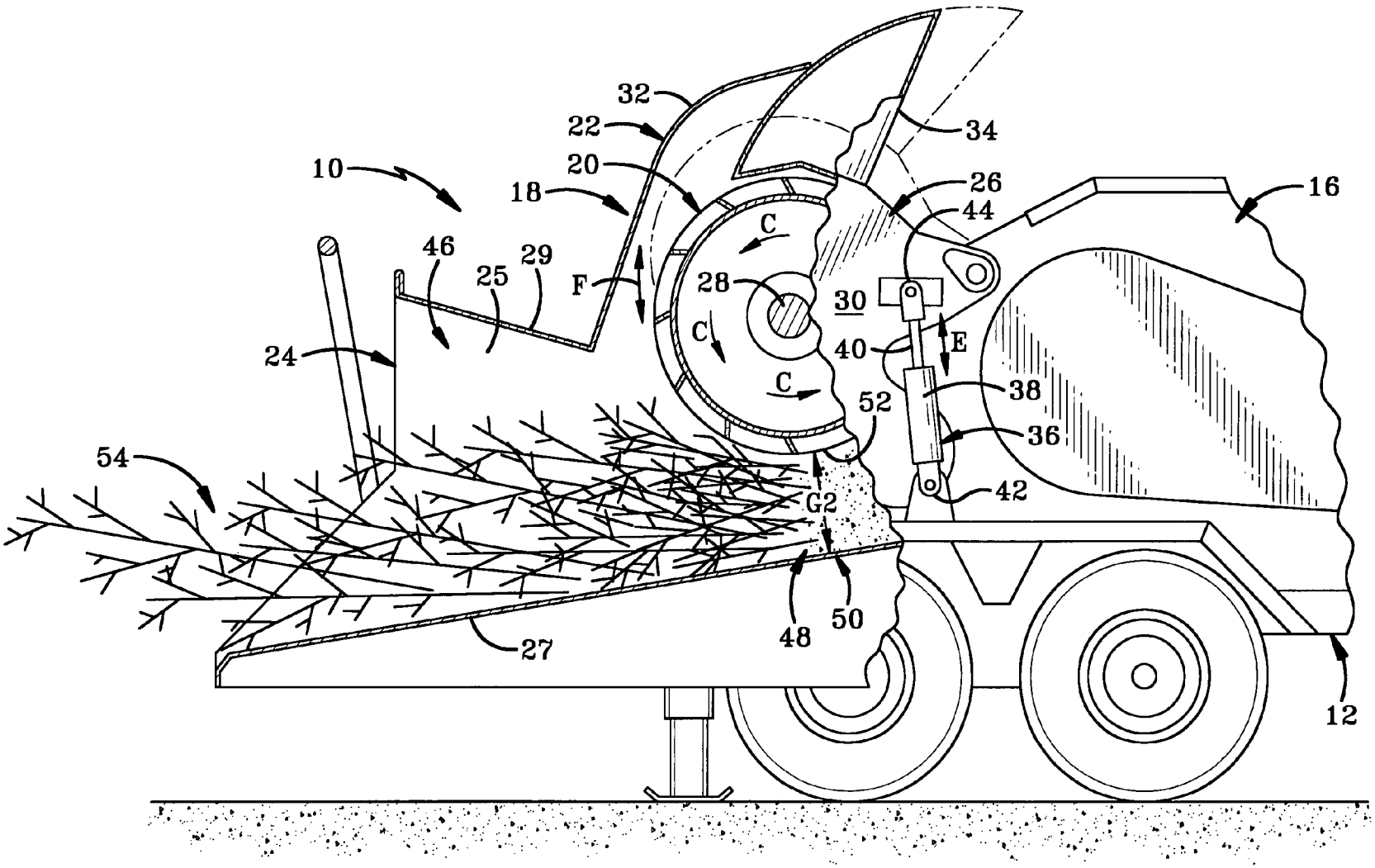
FIG. 4 is similar to FIG. 3 and shows the feed wheel having been moved by the actuator to a relatively lower position to facilitate feeding the feed material into the wood chipper.

With reference to FIGS. 3-4 and in accordance with a feature of the invention, the feeding of material via feed wheel 20 is partially described. With feed wheel 20 rotating in the forward direction as indicated by Arrows C, feed material 54 is fed via input 46 of feed chute 24 into throat 48, adjacent which feed wheel 20 contacts a portion of feed material 54 and draws it through throat 48 toward cutting assembly 16. While feed material 54 is shown schematically as tree branches which may be large or small, various materials may be fed into wood chipper 10. As will be detailed further below and with reference to FIG. 4, actuator 36 is operated to alternately retract and extend piston 40 as indicated at Arrows E to move feed wheel 20 back and forth as indicated at Arrow F respectively to a lowered position represented by solid lines and subsequently to its original position indicated by dot dashed lines. In this lowered position, feed wheel 20 and gap-bounding member 50 define therebetween a gap G2 which is smaller than gap G1 of FIG. 3.

With continued reference to FIGS. 3-4, and in accordance with a feature of the invention, actuator 36 may be operated to retract and extend in a pulsating manner at predetermined time intervals whereby feed wheel 20 is respectively lowered and raised at said time intervals. Actuator 36 is thus part of a pulsating mechanism for moving feed wheel 20 in a pulsating manner up and down as indicated by Arrow F in order to alternate the size of the gap of throat 48 between, for example, gap G1 and gap G2. It is noted that gaps G1 and G2 are merely representative of two different gap sizes or distances which will vary in accordance with a particular scenario and depends upon the amount of force applied by actuator 36 as well as the type of feed material 54 being fed into wood chipper 10. Obviously, the more that feed material 54 gives in response to the pressure or force applied by actuator 36 via feed wheel 20, the more the gap will change. Thus, in some cases the gap will narrow and widen in an alternating fashion to different degrees whereas when the feed material is sufficiently sturdy and thus does not give, the gap may not change at all, at least not noticeably, in response to the amount of force applied. Whether or not the gap between feed wheel 20 and gap-bounding member 50 changes in response to the force applied via actuator 36, the downward force or pressure will allow feed wheel 20 to better grip or grasp feed material 54 in order to facilitate pulling feed material 54 toward cutting assembly 16. In most cases, the force applied by actuator 36 will move feed wheel 20 up and down and this is particularly useful for feed material in the form of branches because the downward movement of feed wheel 20 is sufficient to break or crush Y-branches or crotches as they are known in the art. This facilitates the feeding of the feed material into wood chipper 10.

As previously noted, the pulsating motion of feed wheel 20 occurs at predetermined time intervals. Thus, the intermittent time periods that feed wheel 20 remains in a relatively lowered position are predetermined as well as the intermittent time periods that feed wheel 20 remains in a relatively raised position. Most commonly, actuator 36 is controlled to apply a first relatively lesser or normal force or pressure via feed wheel 20 toward feed material 54 and then at regular time intervals actuator 36 is retracted at a predetermined amount of force to apply a relatively greater force to feed wheel 20 and feed material 54 for relatively short time periods in comparison with the time periods that the normal pressure is applied. Thus, for instance, feed wheel 20 may be operated at the normal down pressure for a preferred duration of 4 to 6 seconds and then at the increased down pressure for a preferred duration of 1 to 1.5 seconds. While these time periods may vary, these time ranges provide an example of the type of cycle which will allow for an increased down pressure which will not stall the engine due to the increased load translated from feed wheel 20 during this increased down pressure. Typically, the increased down pressure is maintained for no more than 2-second time periods and the normal down pressure for no more than 10-second time periods. In addition, the normal down pressure time periods are typically from two to ten times as long as the increased down pressure time periods and preferably two to six times as long.

The exemplary embodiment in the figures includes a single feed wheel although it is common within the art to have a pair of feed wheels. Thus, it is noted that the gap-bounding member represented at 50 may also be a lower feed wheel so that the gap is defined between the upper and lower feed wheels. In addition, it is noted that the exemplary embodiment shows the feed wheel being movable in order to change the size of the gap during the pulsating movement of the feed wheel. However, it is within the scope of the invention that a gap-bounding member like member 50 or a second feed wheel acting as the gap-bounding member may be movable instead of the feed wheel shown or in addition to movement of the feed wheel as shown in the figures. Thus, while it may be preferred and easier to move the feed wheel to change the gap or to move the upper feed wheel in a wood chipper having a pair of feed wheels, at least one of the gap-bounding member and the feed wheel will be movable toward one another in order to effect the pulsating movement required for the invention.

Figure 5:
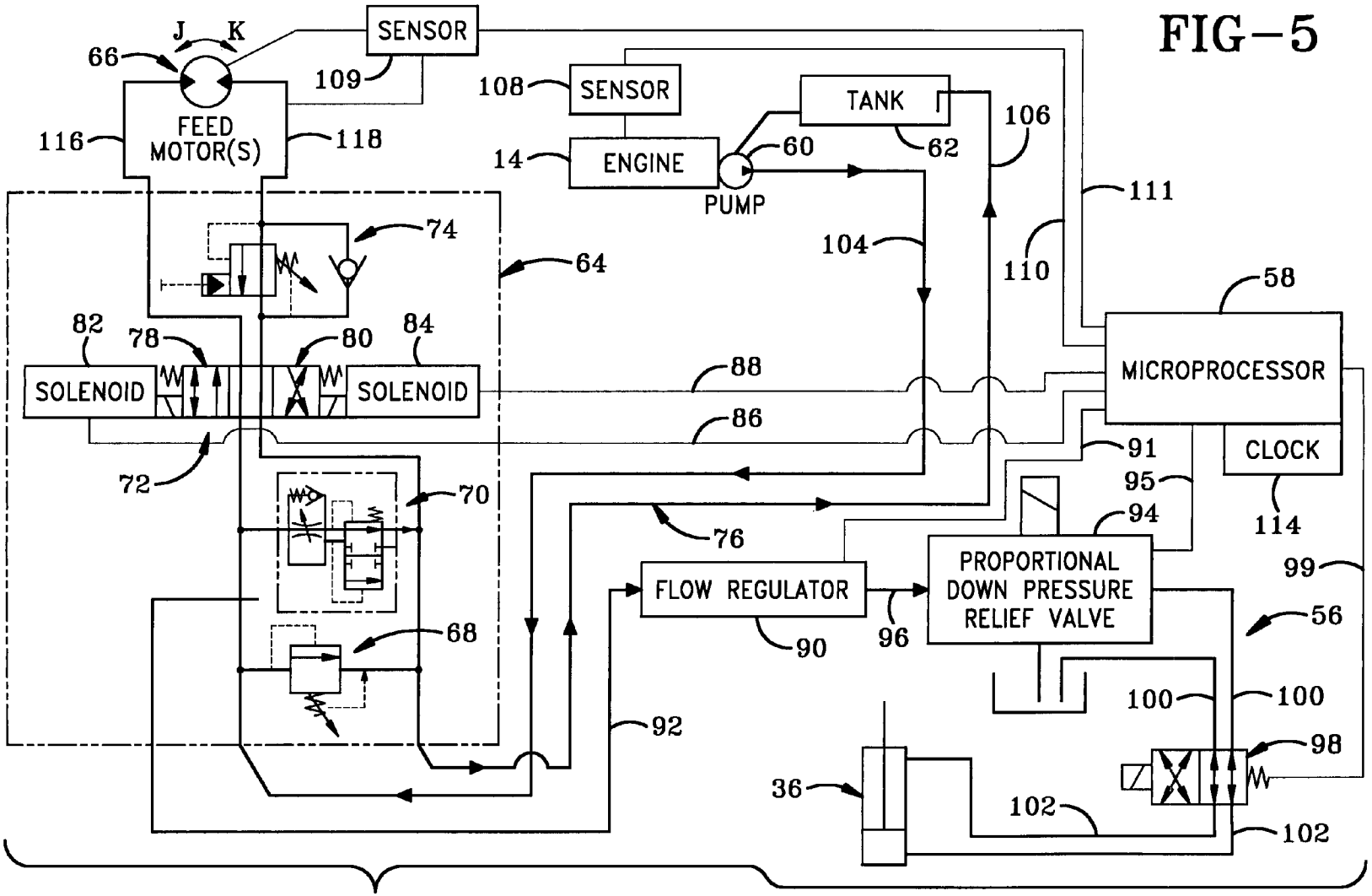
FIG. 5 is a diagrammatic view of the control system of the present invention.

While wood chipper 10 has been described as providing pulsating down pressure at predetermined intervals, a microprocessor and sensor system may also be provided as described herein below. With reference to FIG. 5 and in accordance with another feature of the invention, wood chipper 10 further includes a hydraulic system 56 and may include an electronic control unit (ECU) 58 as shown as a microprocessor which controls the various hydraulic and related elements in order to produce the desired movement of feed wheel 20. Hydraulic system 56 includes a hydraulic pump 60 which is powered by engine 14. Hydraulic system 56 further includes a reservoir or tank 62, a valve block 64 and one or more hydraulic feed motors 66. Valve block 64 includes a relief valve 68, a flow regulator or flow control valve 70, a directional control valve assembly 72 and a counterbalance valve 74. These various elements of the hydraulic system 56 are interconnected by hydraulic lines as generally indicated at 76. Directional control valve assembly 72 includes a first or forward directional control valve 78 and a second or reverse directional control valve 80. A first or forward solenoid 82 is operatively connected to forward directional control valve 78 and a second or reverse solenoid 84 is operatively connected to a reverse directional control valve 80. First solenoid 82 is in electrical communication with microprocessor 58 via a first electrical circuit 86. Likewise, second solenoid 84 is in electrical communication with microprocessor 58 via a second electrical circuit 88. Hydraulic system 56 further includes a flow regulator 90 in fluid communication with valve block 64 via hydraulic line 92, a proportional down pressure relief valve 94 in fluid communication with regulator 90 via hydraulic line 96, an actuator control valve 98 in fluid communication with relief valve 94 via hydraulic lines 100 and actuator 36, which is in fluid communication with control valve 98 via hydraulic lines 102. Microprocessor 58 is in electrical communication with flow regulator 90 via a regulator electric circuit 91, with relief valve 94 via a relief valve electric circuit 95 and with control valve 98 via a control valve electric circuit 99 via a solenoid.

With continued reference to FIG. 5, the control system of wood chipper 10 may further include a sensor 108 for sensing a load on engine 14 or cutting assembly 16 (FIG. 1). Sensor 108 is in electrical communication via a sensor electrical circuit 110 with ECU 58. While sensor 108 may sense this load in a variety of ways, most commonly sensor 108 senses the operational speed of engine 14 so that a reduction in the operational speed of engine 14 indicates an increased load upon engine 14 or cutting assembly 16. Conveniently, sensor 108 may be a tachometer which is typically provided with engine 14. The control system further includes a timing device in the form of a clock 114 which is in electrical communication with ECU 58. ECU 58 may be in communication with the various components other than by electrical circuits, for example, radio frequency or other suitable mechanisms.

With continued reference to FIG. 5, the operation of hydraulic system 56 is described. Pump 60 is powered by engine 14 to pump hydraulic fluid through a feed line 104 to valve block 64. Hydraulic fluid is returned from valve block 64 via a return line 106 to tank 46. When first and second directional control valves 78 and 80 are properly configured, hydraulic fluid flows via hydraulic lines 116 and 118 in order to rotate feed motor 66 in either a forward direction as indicated at Arrow J or a reverse direction as indicated at Arrow K to respectively rotate feed wheel 20 in the forward direction (Arrows C in FIGS. 3-4) or the reverse direction. The control system of wood chipper may further include a sensor 109 for sensing a load on feed wheel 20, feed motors 66 or hydraulic pressure on the hydraulic fluid which drives feed motors 66. Sensor 109 is in electrical communication with microprocessor 58 via a sensor electrical circuit 111.

For this method of operation, microprocessor 58 controls activation and inactivation of valves 78 and 80 in order to control feed motor 66 to rotate in the forward direction, rotate in the reverse direction or to stop and remained stopped as long as desired. More particularly, microprocessor 58 sends an electrical signal to activate solenoid 82, which in turn activates valve 78 to allow the flow of hydraulic fluid from feed line 104 into hydraulic line 116 in order to rotate feed motor 66 in the forward direction indicated by Arrow J. Similarly, microprocessor 58 sends an electrical signal via circuit 88 to activate solenoid 84, which in turn activates second directional control valve 80. Activation of valve 80 allows hydraulic fluid to flow from feed line 104 into hydraulic line 118 in order to rotate feed wheel 66 in a reverse direction indicated by Arrow K. It is noted that first and second control valves 78 and 80 are operated in the alternative. That is, in order to rotate feed motor 66 in a forward direction, microprocessor 58 activates first solenoid 78 while second solenoid 84 and second valve 80 remain in or are moved to their respective inactivated positions. To rotate feed motor 66 in the reverse direction, the reverse is true so that microprocessor 58 activates solenoid 84 while solenoid 82 is inactivated. In order to stop the rotation of feed motor 66 in either direction, microprocessor 58 opens circuits 86 and 88 so that solenoids 82 and 84 are each inactivated and valves 78 and 80 are likewise inactivated. In this inactivated state, no hydraulic fluid flows through lines 116 and 118 and therefore feed motor 66 stops rotating.

Microprocessor 58 thus controls the flow of hydraulic fluid through flow regulator 90, proportional relief valve 94, control valve 98 and actuator 36 in order to control the pulsating force applied by actuator 36 in either an extended or retracted direction thereof in order to control the pulsating force applied to and movement of feed wheel 20 as previously discussed. More particularly, microprocessor 58 controls relief valve 94 via circuit 95 in order to alter the amount of hydraulic fluid flowing from regulator 90 through control valve 98 to actuator 36 in order to control the amount of force upon feed wheel 20 via actuator 36. Thus, flow regulator 90 maintains a given amount of flow of hydraulic fluid and relief valve 94 dumps hydraulic fluid in a proportional manner controlled by microprocessor 58 in order to control the amount of fluid going to actuator 36 and thus the amount of force applied to feed material 54 via feed wheel 20. Directional control valve 98 controls the direction of flow of hydraulic fluid through lines 102 and thus determines whether piston 40 of actuator 36 will be extended or retracted. Alternately, microprocessor 58 may control a flow regulator such as regulator 90 in order to control the amount of fluid going to actuator 36 without the use of a relief valve like valve 94. A variety of other configurations and methods may be used to control the down pressure applied by actuator 36, to include the use of potentiometers, in-line resistors, a modulated signal from the microprocessor or any other suitable mechanisms known in the art. Microprocessor 58 is configured with a logic circuit which controls hydraulic system 56 generally, to include information from clock 114 in order to control the predetermined time intervals for the movement or application of pulsating force to feed wheel 20 via actuator 36.

Figure 6:
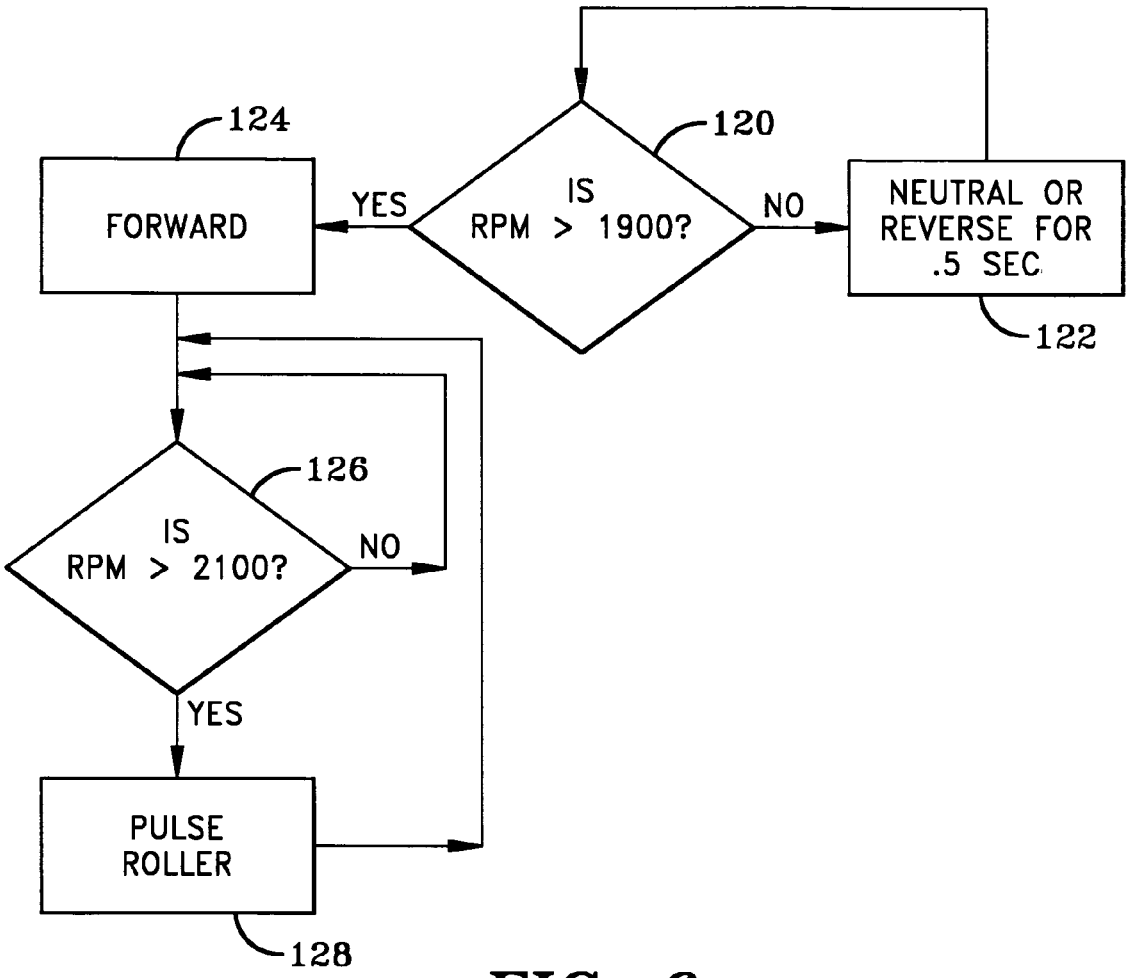
FIG. 6 is a flow chart related to the pulsating movement of the feed wheel with respect to operational speed of the cutting assembly or engine of the wood chipper.

With reference to FIG. 6, more specific control of the pulsating mechanism of the invention is described. When more complete control of the pulse is required, the logic circuit of microprocessor 58 (FIG. 5) may be used to control when the pulsating mechanism will be in effect in accordance with the load on cutting assembly 16 or engine 14. Sensor 108 (FIG. 5) senses the load typically by determining the operational speed of engine 14 or assembly 16 and signals microprocessor 58 to that effect via circuit 110. As indicated at block 120 in FIG. 6, microprocessor 58 determines via sensor 108 whether the operational speed or RPMs of engine 14 are greater than a first threshold value such as 1900 RPMs. If the operational speed is not above this threshold, microprocessor 58 controls feed wheel 20 to remain in neutral or to reverse for a short period such as 0.5 seconds. Microprocessor 58 continually checks whether the operational speed of engine 14 has exceeded the first threshold and waits with the feed wheel either in neutral or reverse until the operational speed has exceeded this threshold before controlling feed wheel 20 to rotate in the forward direction as indicated at block 124. Once feed wheel 20 is rotating in the forward direction, microprocessor 58 determines whether the operational speed of engine 14 and/or assembly 16 exceeds a second threshold which is greater than the first threshold, for example 2100 RPMs. If not, microprocessor 58 will not operate actuator 36 to apply any additional force to feed wheel 20. If the second threshold is exceeded, microprocessor 58 pulses the roller or feed wheel 20 as indicated at block 128 at the relatively lesser and greater forces discussed earlier. Thus, the pulsating force applied to feed wheel 20 at predetermined time intervals only occurs once the second threshold is exceeded. Once this pulsating mechanism is put into effect, microprocessor 58 continues to monitor the load on cutting assembly 16 and/or engine 14 by determining whether the operational speed has dropped below the second threshold, and if so, discontinues the pulsating operation until the second threshold is exceeded.

As described in the previous paragraph, microprocessor or ECU 58 controls the pulsating mechanism in response to an input from sensor 108. However, sensor 109 can be used in a similar fashion wherein sensor 109 senses a load on feed wheel 20, feed motor 66 or the hydraulic pressure on the hydraulic fluid that drives feed motor 66 and signal ECU 58 via circuit 111. Thus, sensor 109 may be used in a similar fashion as sensor 108 so that if the load sensed by sensor 109 is too great, ECU 58 will not permit the pulsating operation.

While the invention has been discussed thus far as relating to a pulsating mechanism, another important feature of the invention is the ability of ECU 58 to control force supplied via at least one of the feed wheel and the gap bounding member toward one another. As mentioned early in the application, ECU 58 in conjunction with hydraulic system 56 permit this force applied to the feed material to be controlled in virtually any manner desired. Thus, this force or down pressure may be controlled in innumerable ways other than simply a pulsating operation. This is particularly useful because ECU 58 is able to respond to various specific operational conditions of wood chipper 10.

As previously described, this may involve information regarding the load on engine 14, cutting assembly 16, feed wheel 20, feed motor 66 or the hydraulic fluid pressure associated with driving the feed motors. Thus, for instance, if the load sensed by sensors 108 or 109 reaches an undesirably high threshold, ECU 58 can respond via hydraulic system 56 to reduce the force applied by feed wheel 20 toward the feed material, which may include widening the gap between feed wheel 20 and gap bounding member 50. Alternately, for example, ECU 58 may increase the force in response to a decreased load sensed by sensors 108 or 109. This increased force may of course include narrowing the gap. ECU 58 may also be used to apply the force in an alternating manner which is not necessarily in a pulsating manner having predetermined time intervals. For instance, sensors 108 or 109 may be used to continuously monitor the various loads as previously described so that ECU 58 may continuously change the force applied by feed wheel 20 to the feed material depending on the specific signal given by sensors 108 or 109. Thus, for instance, the load may increase on one of the various operational structures previously discussed so that ECU 58 reduces the force applied while immediately thereafter the load may be sufficiently decreased so that ECU 58 increases the force applied by feed wheel 20.

In addition, ECU 58 may be programmed to create predetermined responses which are not of a pulsating manner. For instance, ECU 58 may control feed wheel 20 in order to apply a first predetermined force for a first predetermined period of time and subsequently a second predetermined force for a second predetermined period of time wherein the first and second forces are different from one another. Thus, for instance, feed wheel 20 may apply such a first force for the first period and then apply a second greater force for a second period of time. If desired, feed wheel 20 might subsequently provide a third force which is greater than the second force. Alternately, ECU 58 may be configured to provide such a first force and a second force which is smaller than the first force and subsequently a third force which is smaller than the second force. In any case, it is clear that ECU 58 may control the force applied and the gap between feed wheel 20 and gap bounding member 50 in virtually an infinite number of ways, including predetermined forces and time periods whether or not they have a pulsating nature. It is further noted that ECU 58 may control application of the force in a sudden manner or in a gradual manner. Thus, for instance, a sudden change from a lower pressure to a higher pressure may be used to crush Y-branches, as previously discussed. Alternately, the pressure may be increased or decreased gradually, to include a constant rate of change or a variable rate of change depending on the desired effect.

Thus, wood chipper 10 in one preferred configuration provides a feed mechanism which in an automated mode provides pulsating force or pressure applied at predetermined time intervals on feed material in order to facilitate the feeding of the material via a feed wheel. In addition, wood chipper 10 includes an ECU 58 configured to control the force or pressure applied on feed material in virtually any manner desired.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method comprising the steps of:

rotating a feed wheel which is rotatably mounted on a carriage of a wood chipper to facilitate moving feed material toward a cutting assembly of the wood chipper via a gap defined between the feed wheel and a gap-bounding member wherein at least one of the carriage and gap-bounding member is movable toward and away from the other of the carriage and gap-bounding member; and controlling with an electronic control unit (ECU) force applied via at least one of the carriage and the gap-bounding member toward the other of the carriage and gap-bounding member; and wherein the step of controlling includes the steps of increasing and decreasing force applied toward the other of the carriage and gap-bounding member in an alternating manner.

2. The method of claim 1 wherein the step of controlling includes the step of controlling force applied in response to an input to the ECU related to an operational condition of the wood chipper.

3. The method of claim 2 wherein the step of controlling includes the step of controlling force applied in response to an input to the ECU related to an operational condition of at least one of the cutting assembly, an engine which powers the cutting assembly, the feed wheel and a hydraulic system which powers movement of the feed wheel.

4. The method of claim 3 wherein the step of controlling includes the step of controlling force applied in response to an input to the ECU related to a load on at least one of the cutting assembly, the engine, the feed wheel and the hydraulic system.

5. The method of claim 1 wherein the step of controlling includes the step of decreasing force applied toward the other of the carriage and gap-bounding member in response to an increased load on one of the cutting assembly, the engine and the feed wheel.

6. The method of claim 5 wherein the step of decreasing includes the step of widening the gap.

7. The method of claim 1 wherein the step of controlling includes the step of increasing force applied toward the other of the carriage and gap-bounding member in response to a decreased load on one of the cutting assembly, the engine and the feed wheel.

8. The method of claim 7 wherein the step of increasing includes the step of narrowing the gap.

9. The method of claim 1 wherein the step of controlling includes the step of maintaining substantially constant force applied toward the other of the carriage and gap-bounding member in response to a load on one of the cutting assembly, the engine and the feed wheel wherein the load is within a predetermined range.

10. The method of claim 1 wherein the step of controlling includes the step of applying a first force for a first predetermined time period and applying a second force which is different than the first force for a second predetermined time period.

11. The method of claim 10 wherein the step of controlling includes the step of applying a third force for a third predetermined time period wherein the third force is different than each of the first and second forces.

12. A method comprising the steps of:

rotating a feed wheel which is rotatably mounted on a carriage of a wood chipper to facilitate moving feed material toward a cutting assembly of the wood chipper via a gap defined between the feed wheel and a gap-bounding member wherein at least one of the carriage and gap-bounding member is movable toward and away from the other of the carriage and gap-bounding member; and controlling with an electronic control unit force applied via at least one of the carriage and the gap-bounding member toward the other of the carriage and gap-bounding member;

wherein the step of controlling includes the step of applying force in a pulsating manner at predetermined time intervals via at least one of the carriage and the gap-bounding member toward the other of the carriage and gap-bounding member.

13. The method of claim 12 further including the step of sensing an operational speed of one of the cutting assembly and an engine which powers the cutting assembly; and wherein the step of applying includes the step of applying the force only if the operational speed exceeds a predetermined threshold.

14. The method of claim 13 further including the step of at least one of stopping and reversing rotation of the feed wheel if the operational speed does not exceed the threshold to allow sufficient time for the operational speed of the one of the cutting assembly and the engine to exceed the threshold.

15. The method of claim 12 wherein the step of applying includes the steps of narrowing and widening the gap in an alternating manner at predetermined time intervals.

16. The method of claim 12 wherein the step of applying includes the step of applying a relatively greater force during a plurality of intermittent first time periods and applying a relatively lesser force which is substantially constant during a plurality of intermittent second time periods which alternate with the first time periods.

17. The method of claim 12 wherein the step of applying includes the step of applying a relatively greater force during a plurality of intermittent first time periods and applying a relatively lesser force during a plurality of intermittent second time periods which alternate with the first time periods and which are longer than the first time periods of the relatively greater force.

18. The method of claim 17 wherein the step of applying includes the step of applying the relatively lesser force during second time periods which are from two to ten times as long as the first time periods of the relatively greater force.

19. The method of claim 18 wherein the step of applying includes the step of applying the relatively greater force during first time periods which are no longer than 2.0 seconds and applying the relatively lesser force during second time periods which are no longer than 10.0 seconds.

20. The method of claim 1 wherein the step of rotating comprises the step of rotating a feed wheel which is rotatably mounted on a carriage of a wood chipper to facilitate moving feed material toward a cutting assembly of the wood chipper via a gap defined between the feed wheel and a wall of the wood chipper which serves as a gap-bounding member wherein at least one of the carriage and gap-bounding member is movable toward and away from the other of the carriage and gap-bounding member.

21. The method of claim 20 wherein the carriage is movable toward and away from the gap-bounding member.

22. The method of claim 20 wherein the step of rotating comprises the step of rotating a feed wheel which is rotatably mounted on a carriage of a wood chipper and is within a housing of the wood chipper to facilitate moving feed material toward a cutting assembly of the wood chipper via a gap defined between the feed wheel and a wall of the housing which serves as a gap-bounding member wherein at least one of the carriage and gap-bounding member is movable toward and away from the other of the carriage and gap-bounding member.

23. The method of claim 20 wherein the step of rotating comprises the step of rotating a feed wheel which is rotatably mounted on a carriage of a wood chipper adjacent a feed chute through which feed material may be fed toward the feed wheel to facilitate moving feed material toward a cutting assembly of the wood chipper via a gap defined between the feed wheel and a wall of the feed chute which serves as a gap-bounding member wherein at least one of the carriage and gap-bounding member is movable toward and away from the other of the carriage and gap-bounding member.

24. The method of claim 1 wherein the step of controlling comprises the step of moving one of the carriage and the gap-bounding member toward the other of the carriage and gap-bounding member to narrow the gap.

25. The method of claim 24 wherein the step of moving comprises the step of pivoting one of the carriage and the gap-bounding member toward the other of the carriage and gap-bounding member to narrow the gap.

26. The method of claim 25 wherein the step of rotating comprises the step of rotating the feed wheel about a first axis; and the step of pivoting comprises the step of pivoting the one of the carriage and gap-bounding member about a second axis substantially parallel to the first axis.

27. The method of claim 1 wherein the step of controlling comprises the step of operating an actuator mounted on one of the carriage and gap-bounding member to apply the force.

28. The method of claim 27 wherein the step of operating comprises the step of operating an extendable and retractable actuator mounted on one of the carriage and gap-bounding member to apply the force.

29. The method of claim 27 wherein the step of operating comprises the step of operating an actuator mounted on a frame of the wood chipper to apply the force.

30. The method of claim 29 wherein the step of operating comprises the step of operating an actuator which is pivotally mounted at a first pivot on one of the carriage and gap-bounding member and pivotally mounted at a second pivot on the frame to apply the force.

31. The method of claim 1 wherein the step of rotating comprises the step of rotating the feed wheel about a first axis; and the step of controlling comprises the step of applying the force in a direction substantially perpendicular to the first axis.

* * * * *